United States Patent [19]

Hara et al.

[11] 4,062,684

[45] Dec. 13, 1977

[54] METHOD FOR FORMING IMAGES BY A STABILIZED COLOR INTENSIFYING TREATMENT

[75] Inventors: Hiroshi Hara; Keiichi Adachi; Hideyuki Kusaba, all of Minami-ashigara, Japan

[73] Assignee: Fuji Photo Film Co., Ltd., Minami-ashigara, Japan

[21] Appl. No.: 708,249

[22] Filed: July 23, 1976

[30] Foreign Application Priority Data

July 23, 1975 Japan ..... 50-89898

[51] Int. Cl.[2] ..... G03C 5/32

[52] U.S. Cl. ..... 96/60 R; 96/22; 96/60 BF; 96/55; 96/66 R

[58] Field of Search ..... 96/60, 22, 55

[56] References Cited

U.S. PATENT DOCUMENTS

| | | | |
|---|---|---|---|
| 3,765,891 | 10/1973 | Travis | 96/55 |
| 3,820,997 | 6/1974 | Shirasu et al. | 96/60 R |
| 3,841,873 | 10/1974 | Mowrey | 96/22 |
| 3,846,130 | 11/1974 | Purol | 96/22 |

*Primary Examiner*—Mary F. Kelley

*Attorney, Agent, or Firm*—Sughrue, Rothwell, Mion, Zinn & Macpeak

[57] ABSTRACT

In an image intensification which comprises reacting a photograhic element comprising a support having provided thereon at least one silver halide emulsion layer with at least one highly active intensifying agent comprising halogenous acids and peroxides in the presence of a reducing agent, and, if necessary or desired, a color former, a method for forming images which comprises treating the photographic element with an intensifying bath comprising 1. at least one nitrogen-containing heterocyclic compound possessing an anti-fogging effect and having no mercapto group;
2. bromide ions in an amount of $1 \times 10^{-4}$ gram ion/-liter or more; and
3. the highly active intensifying agent in an amount of 0.25 mol/liter or more.

25 Claims, No Drawings

METHOD FOR FORMING IMAGES BY A STABILIZED COLOR INTENSIFYING TREATMENT

BACKGROUND OF THE INVENTION

1. Field of the Invention

The present invention relates to a method for forming images by image intensifying, more particularly, to a method for forming images by image intensifying minimizing undesired variations in photographic properties (fog, sensitometric gradation, maximum density of colored images, etc.) due to catalytic nuclei poisoning. In addition, the present invention relates to a method for forming images in which a reduction of the intensifying effect is prevented and fog is minimizee. One characteristic of the present invention is to provide a method for forming images by an intensifying treatment utilizing a photographic element comprising an image-forming unit layer using light sensitive silver halide in a smaller amount than the stoichiometric amount, based on color former, in combination with a sufficient amount of color former.

2. Description of the Prior Art

Various methods for intensifying the formation of images by subjecting a silver halide light-sensitive material to intensifying upon development are known.

The formation of dyes by a process which comprises oxidation of a p-phenylene-diamine color developing agent due to decomposition of hydrogen peroxide on a silver catalyst in the presence of a color former, followed by coupling with the color former (this phenomenon is referred to as "color intensification") is described in, for example, Friedman, *History of Color Photography* 2nd edition, page 406 (1956). Further, with regard to other various photographic techniques utilizing decomposition of peroxides on the surface of a noble metal, there are descriptions in German Patent Applications (OLS) Nos. 1,813,920, 1,950,102, 1,955,901, 1,961,029, 2,044,833, 2,044,993, 2,056,360, 2,056,359 and 2,120,091, etc. On the other hand, it has been known for a considerable time that peroxides are decomposed on the surface of a noble metal. For instance, many examples thereof are described in *Shokubai Kaguka Koza* (*Lectures of Catalyst Technology*), volume 2 (1966) published by Chijin Shokan, Tokyo.

Furthermore, with respect to color intensifying using a cobalt complex on the surface of a noble metal, there are descriptions in, for example, Japanese Patent Applications (OPI) Nos. 9728/73, 9729/73, 48130/73, 84229/74, 84239/74, 84240/74, 97614/74, 102340/74, 102341/74, etc.

Further, a color intensifying method using halogenous acids such as chlorites or the like is described in Japanese Patent Applications Nos. 128,237/74 and 139917/74.

These intensifying methods can be facilitated using conventional silver halide light sensitive materials, in particular, low silver type light sensitive materials or the likes as are described in Japanese Patent Application (OPI) No. 9728/73. That is, these methods form dyes due to a coupling reaction of the oxidation product of a color developing agent caused by a reduction of silver halide with a color former, which are particularly characterized in that the amount of silver is greatly reduced.

In these three intensifying methods, the intensifying methods which use halogenous acids and the method which uses peroxides are preferred because of the high intensifying activity as compared to the intensifying method using a cobalt (III) complex compound as is described in the aforementioned Japanese Patent Application (OPI) 9728/73, etc.

However, halogeneous acids or peroxides, due to their strong oxidation capability, tend to oxidize a reducing agent (for example, a color developing agent, etc.) even at areas other than image areas composed of metal silver during the intensifying and form dyes by reacting the oxidation product with the color former (for example, coupling reaction, etc.) so that fog is liable to form. Such formation of fog is conceivably also suggested by the description with regard to the decomposition of peroxides, appearing in, for example, W.C. Schumb, et al., *Hydrogen Peroxide,* page 590 (1955), etc.

On the other hand, there is the defect in intensifying processes using highly active halogenous acids or peroxides that the intensifying effect tends to be restrained by various compounds which can be present during the intensifying process, e.g., compounds which are carried from a developing bath (e.g., potassium iodide, etc.), additives incorporated in the light-sensitive material, etc.

Such a restraint of the intensifying effect could also be expected from the fact that decomposition of peroxides on a noble metal, heretofore known, is poisoned by various compounds or ions. For example, it is described in *Shokubai Kogaku Koza* (*Lectures of Catalyst Technology*), Volume 2, pages 272–296 (1966) published by Chijin Shokan, Tokyo, that $H_2S$, HCN, $HgCl_2$, $Hg(CN)_2$, $I_2$, $NH_2OH$, $C_6H_5NH_2$, etc., are such (catalyst) poisons. These compounds restrain the intensification of metal silver and the like on a catalyst by not only peroxides but also by halogenous acids.

In addition, the intensifying effect of halogenous acids or peroxides is inhibited in a process of developing a silver halide photographic light-sensitive material; this might be because bromine ions or iodine ions in a silver halide are released and the released ions are absorbed on the surface of the developed silver so that the catalytic nuclei are thereby poisoned. Further, in most cases, bromine ions are added in an amount of from 0.1 g/liter to 10 g/liter to a developer for anti-fogging, hardening, maintaining the activity of a continuously used liquid constant, etc., and are carried into an intensifying bath to poison the catalytic nuclei. The oxidation of a reducing agent (for example, a color developing agent, etc.) with an intensifying agent on the thus poisoned catalyst is strongly restrained, and, therefore, the intensifying effect is inhibited.

These compounds having an intensifying effect, such as peroxides, halogenous acids, cobalt (III) complex compounds and the like, are referred to as an intensifying agent; and peroxides halogenous acids and the like which possess a higher activity than cobalt (III) complex compounds are referred to as highly active intensifying agents. A processing bath containing an intensifying agent is referred to as an intensifying bath.

On the other hand, as mentioned hereinabove, a highly active intensifying agent (for example, peroxides, halogenous acids, etc.) is liable to cause fog, especially at non-image areas, and it is thus conceivable one could prevent fog by having an anti-fogging agent present in a process where a reducing agent (for example, a color reducing agent, etc.) is oxidized with such a highly active intensifying agent on a catalyst. However, in this case, not all known anti-fogging agents are effective, and effective ones are limited to those having specific chemical structures. Furthermore, if a compound having such an anti-fogging effect coexits in the system, the poisoning effect due to a compound which would poison catalyst nuclei as mentioned above in particularly strongly exibited, as compared to the case where no anti-fogging agent is present. As a result, the intensifying effect is remarkably inhibited.

SUMMARY OF THE INVENTION

A first object of the present invention is to provide a method for forming images in which both inhibition of the intensifying activity and the formation of fog during development processing of a photographic element comprising at least one silver halide emulsion layer are minimized, and the intensifying activity is enhanced.

A second object of the present invention is to provide a method for forming images in which variations of photographic properties (fog, sensitometric gradation, maximum density of colored images, etc.) accompanied by the poisoning of catalytic nuclei are minimized.

A third object of the present invention is to provide a method for forming using an intensifying bath contaning bromine ions in a large amount ($1 \times 10^{-4}$ mol/liter or more) which does not inhibit the intensifying effect, minimizes the formation of fog and provides a high intensity activity.

The various objects of the present invention are achieved by the following method, that is, a process which comprises an image intensification by reacting a photographic element comprising a support having provided thereon at least one silver halide emulsion layer with an intensifying bath containing at least one highly active intensifying agent selected from a halogeneous acid and a peroxide in the presence of a reducing agent, and, if necessary or desired, a color former, the intensifying bath comprising at least one nitrogen-containing heterocyclic compound which has no mercapto group and which possesses an anti-fogging effect, bromide ions in an amount of $1 \times 10^{-4}$ gram ion/liter or more, and the highly active intensifying agent in an amount of 0.25 mol/liter or more.

The objects of the present invention are also achieved by a method of intensifying images by treating a photographic element with an intensifying bath containing at least one highly active intensifying agent selected from a halogenous acid and a peroxide and comprising at least one nitrogen-containing heterocyclic compounds having no mercapto group and possessing an anti-fogging agent, and at least water-soluble bromide which releases bromide ions.

DETAILED DESCRIPTION OF THE INVENTION

The processing steps of the present invention usually comprise a color developing step, an intensifying step, a bleaching step and a fixing step (or a blixing step instead of bleaching and fixing steps). Further, the intensifying step may be combined with the color developing step or the bleaching and/or fixing step or the blixing step.

Preferred examples of nitrogen-containing heterocyclic compounds having no mercapto group and which possess an anti-fogging effect which can be employed in accordance with the present invention include a five- or six-membered heterocyclic compound containing two or more nitrogen atoms, preferably 2 to 4 nitrogen atoms, a condensed ring compound thereof, and nitrogen-containing heterocyclic compounds represented by formulae (I) and (II):

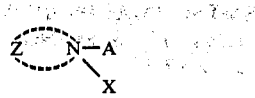
(I)

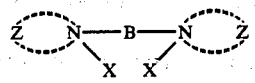
(II)

wherein: A is a substituted or unsubstituted alkyl group, where preferred substituents include a hydroxyl group, an alkoxy group having 1 to 4 carbon atoms, a carboxy group or a sulfo group, etc., and where the alkyl group or moiety most preferably has 1 to 4 carbon atoms, an alkenyl group, most preferably an alkenyl group having 2 to 10 carbon atoms, an alkynyl group, most preferably an alkynyl group having 2 to 10 carbon atoms, an aralkyl group, most preferably an aralkyl group having 7 to 12 carbon atoms, an alicyclic hydrocarbon residue, most preferably an alicyclic hydrocarbon residue having 5 to 10 carbon atoms, or a substituted or unsubstituted aryl group, most preferably where the substituent is a hydroxyl group, an alkoxy group having 1 to 4 carbon atoms or an alkyl group having 1 to 4 carbon atoms, and where the aryl group is monoaryl or biaryl, for example, phenyl, napthyl; and B is one of the following divalent hydrocarbon groups: $-(CH_2)n-$, $-CH_2O-(CH_2)n-OCH_2-$,

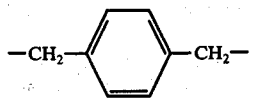

or $-CH_2-O-CH_2-$, wherein $n$ is an integer of 1 to 12, X is an anion other than I such as a halide ion (e.g., chloride, bromide), perchlorate ion, p-tosylate ion, hydrogen sulfate ion, nitrate ion, oxalate ion or boron tetrafluoride ion, etc.; and z is a non-metallic group which forms a hetero ring with an N atom, for example, a non-metallic group conprising carbon, nitrogen, oxygen, sulfur or selenium, which forms a 5- or 6-membered heterocyclic ring or such a heterocyclic ring condensed with a 5- or 6-membered ring, typically condensed with a 5- or 6-membered carbon atom ring.

Preferred examples of five- or six-membered heterocyclic compounds containing two or more nitrogen atoms and condensed ring compounds are 5- or 6-membered heterocyclic compounds containing 2 or more nitrogen atoms and having condensed thereto another 5- or 6-membered benzene ring or heterocyclic ring such as pyridine, pyrazine, pyrimidine, pyridazine, etc.; such heterocyclic compounds and condensed ring compounds are preferably represented by the formulae below:

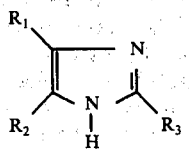
(III)

-continued (IV)

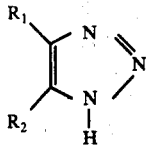

(V)

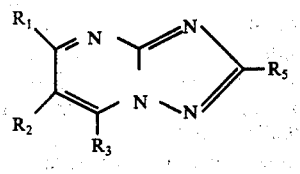

(VI)

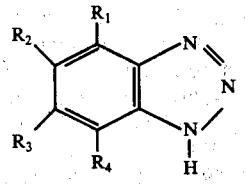

(VII)

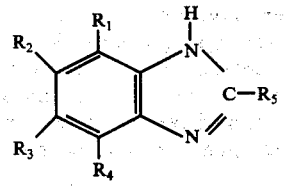

(VIII)

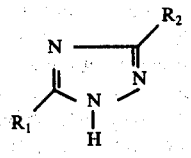

In formulae (III) through (VIII), $R_1$, $R_2$, $R_3$ and $R_4$ each represents a hydrogen atom, an alkyl group, most preferably an alkyl group having 1 to 20 carbon atoms, an aralkyl group, most preferably an aralkyl group having 7 to 12 carbon atoms, an alkenyl group, most preferably an alkenyl group having 2 to 10 carbon atoms, an aryl group, most preferably a mono or biaryl group having 6 to 12 carbon atoms, $—NH_2$, $—NO_2$, a halogen atom, or —OH; when $R_1$ and $R_2$ are an alkyl group, if desired or necessary, they may be combined together to form an alicyclic ring. $R_5$ represents a hydrogen atom, or an alkyl having 1 to 5 carbon atoms.

Representative examples of the compounds in accordance with the present invention are shown below.

(1)

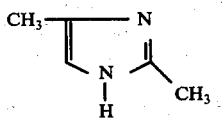

(2)

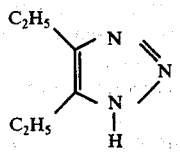

(3)

-continued (4)

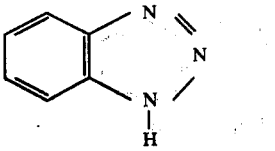

(5)

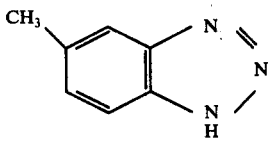

(6)

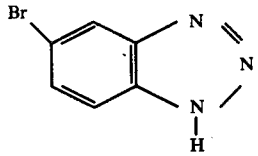

(7)

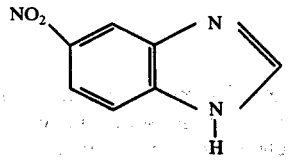

(8)

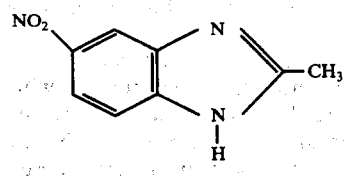

(9)

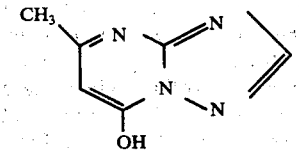

(10)

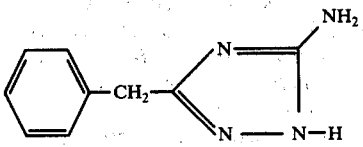

(11)

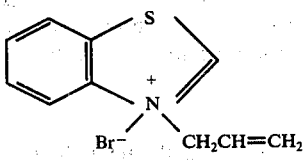

-continued (12)

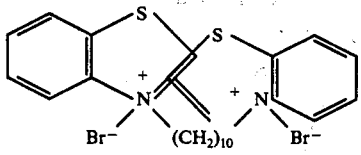

(13)

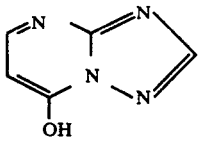

(14)

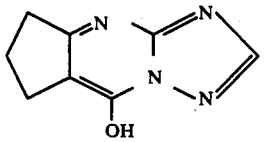

(15)

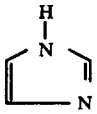

(16)

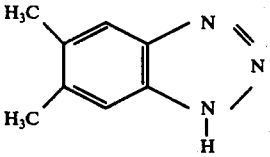

It is preferred that the aforementioned nitrogen-containing heterocyclic compounds which have no mercapto group and which possess anti-fogging effect be incorporated in an amount of about 1 mg to about 10 g, particularly 10 mg to 5 g, per 1 liter of an intensifying solution.

Examples of nitrogen-containing heterocyclic compounds which have no mercapto group and which possess an anti-fogging effect which can be employed in the present invention are also described in the literature below: for example, nitrobenzimidazoles as described in U.S. Pat. No. 2,496,940, British Pat. No. 403,789, U.S. Pat. Nos. 2,497,917 and 2,656,271, etc.; benzotriazole compounds as described in *Nippon Shashin Gakkaishi* volume 11, page 48 (1948); hetero ring compound quarternary salts such as benzothiazolium salts as described in U.S. Pat. Nos. 2,131,038, 2,694,716 and 3,326,681, etc.; tetraazaindenes as described in U.S. Pat. Nos. 2,444,605, 2,444,606, and 2,444,607, etc.; other heterocyclic compounds as described in U.S. Pat. Nos. 2,173,628, 2,324,123 and 2,444,608, etc.; and compounds as described in *Kagaku Shashin Binran* (*Handbook of Photographic Technology*), volume 2, page 119 (1959), published by Maruzen, Tokyo.

The bromine ions used in the present invention are obtained by adding to an intensifying solution a water-soluble bromide which dissociates bromide ions, as are described below. Preferred of such materials are those represented by the following formula (IX):

$$M(Br)_n \qquad \text{(IX)}$$

wherein: M represents an alkali metal (e.g., sodium, potassium, lithium, etc.) an alkaine earth metal (e.g., magnesium, calcium, etc.) or an ammonium group (e.g., ammonium), etc., and n represents 1 or 2.

These include sodium, potassium and lithium bromide, magnesium and calcium bromide, ammonium bromide, etc.

The halogenous acid compounds employed in the present invention are chlorous acids and bromous acids, which are described in Japanese Patent Applications Nos. 128327/74 and 139917/74. In particular, chlorous acids are preferred. The chlorous acids employed in the present invention include chlorous acid and water-soluble chlorous acid salts. Examples of such chlorous acid salts are salts of alkali metals (e.g., lithium, sodium, potassium, etc.) or alkaline earth metals (e.g., magnesium, calcium, strontium, barium, etc.) of chlorous acid, and an ammonium salts of chlorous acid. In particular, sodium chlorite and potassium chlorite are preferred.

The peroxide compounds which can be employed in the present invention are those as described in Friedman, *History of Color Photography,* Second Edition, page 406 (1956), German Patent Applications (OLS) Nos. 1,813,920, 1,950,102, 1,955,901, 1,961,029, 2,044,833, 2,044,993, 2,056,360, 2,056,359 and 2,120,091, etc. Specific examples of peroxide compounds which can be employed in the present invention include inorganic peroxo compounds such as hydrogen peroxide, chlorine dioxide, peroxoborate, peroxocarbonate, peroxosilicate, peroxophosphate, and organic peroxo compounds such as perbenzoates, etc. More preferred examples of peroxide compounds are hydrogen peroxide, peroxoborate and peroxocarbonate.

The highly active intensifying agent comprising these halogenous acid salts and peroxide compounds can also be incorporated in, for example, a bath containing a reducing agent such as a color developing agent (e.g., a color developing bath, etc.), preferably containing such a reducing agent in an amount of not less than about 1 g/liter, and can further be incorporated in a bath subsequent to a bath as referenced above, which later bath is rather preferred, for example, an intensifying bath.

The highly active intensifying agent of the present invention which comprises a halogenous acid compound and a peroxide compound can be used in combination with a stabilizing agent, or can be incorporated in a light sensitive material (a light sensitive photographic emulsion layer, a non-light sensitive photographic auxiliary layer (e.g., a protective layer, a filter layer or an intermediate layer, etc.), etc.) using a stabilizing means for an intensifying agent by adding a precursor of an intensifying agent, as described in, for example, U.S. Pat. No. 3,765,890, etc.

Examples of stabilizing agents such as are set forth above include an urea, an aliphatic acid amide (e.g., succinimide or asparagine, etc.), an aliphatic polyhydric alcohol having 3 to 6 carbon atoms (e.g., erythritol, mannitol or pinacol, etc.), an aliphatic amine (e.g., hexamethylene triamine, etc.), or an acid hydrazide (e.g., diacetylhydrazine, succinic acid hydrazine or malonic acid dihydrazide, etc.).

The highly active intensifying agent to be incorporated in a proacessing bath, e.g., a chlorous acid salt, chlorous acid, chlorine dioxide water, an other peroxide, etc., is effective in an amount of greater than about 0.031 mol per 1 liter of the processing solution, but it is preferred that the agent be added in a range of from 0.25 mol to 17 mols, same basis.

When the highly active intensifying agent is incorporated in a light-sensitive material, it is most preferably incorporated in an amount of about 0.05 mol to 4 mols per 1 mol of silver.

The intensifying liquid employed in the present invention is set to have a pH of 7 to 14, preferably 8 to 13.

The intensifying liquid may further contain other compounds which comprise known developer components. For instance, as an alkali agent or a buffering agent, there can be used sodium hydroxide, potassium carbonate, sodium quinolate, potassium quinolate, sodium (II) phosphate, potassium (II) phosphate, sodium (III) phosphate, potassium (III) phosphate, phosphoric acid, sodium pyrophosphate, potassium pyrophosphate, potassium metaborate, sodium metaborate, borax, etc. It is preferred that at least one of the compounds as described in W.C. Schumb et al., *Hydrogen Peroxide,* pages 515 – 547, be added to an intensifying bath in which a peroxide is incorporated, as a stabilizer for the peroxide.

If necessary, developing accelerating agents can optionally be incorporated in the intensifying liquid. For instance, there are various pyridinium compounds or other cationic compounds, cationic dyes such as phensosafranine, neutral salts such as thallium nitrate or potassium nitrate as described in U.S. Pat. No. 2,648,604, Japanese Patent Publication No. 9503/69, and U.S. Pat. No. 3,671,247; nonionic compounds such as polyethylene glycol or derivatives thereof, e.g., ether with hexitol, monoor or di-esters with a carboxylic acid, a sulfuric ester, a polyethoxyethylbispyridiniummethansulfonate or polyoxyethylenemannitanmonolaurate (i.e., the addition product of mannitanmonolaurate with 2 or 3 ethylene oxides), and polythioethers as described in Japanese Patent Publication No. 9504/69, U.S. Pat. Nos. 2,533,990, 2,531,832, 2,950,970, and 2,577,127; organic solvents or organic amines as described in Japanese Patent Publication 9509/69 and Belgian Patent 682,862; accelerating agents as described in L.F.A. Mason, *Photographic Processing Chemisty,* pages 40–43 (1966), published by Focal Press, London; benzyl alcohol and phenylethyl alcohol as described in U.S. Pat. No. 2,515,147; pyridine, ammonia, hydrazine and amines as described in *Nippon Shashin Gakkaishi,* volume 14, page 74 (1952), etc.

Further, suflates or hydrochlorides of hydroxyl amines, sodium sulfite, potassium sulfite, potassium bisulfite, or sodium bisulfite can be incorporated in the intensifying bath.

In addition, a polyphosphate compound as exemplified by sodium hexamethaphosphate, sodium tetrapolyphosphate, sodium tripolyphosphate, potassium salts of each of these polyphosphates, etc., or amino polycarboxylic acids which are exemplified by ethylenediaminetetraaccetic acid, nitrilotriacetic acid, cyclohexanediaminetetraacetic acid, iminodiacetic acid, N-hydroxymethylethylenediaminetriacetic acid, diethylenetriaminepentaacetic acid, etc., can be used as a softening agent for hard water. While the addition amount varies depending upon the hardness of the water, such are generally used in an amount of about 0.5 to about 1 g/liter. A sequestering agent for calcium or magnesium can also be used, if desired.

Examples of reducing agents which can be used in accordance with the present invention are p-phenylene diamine derivative color developing agents, p-aminophenol derivative color developing agents which are of the onium salt type described in U.S. Pat. No. 3,791,827, etc., dye developing agents as described in U.S. Pat. No. 2,983,606, etc., diffusible dye releasing (DDR) type redox compounds as described in Japanese Patent Application (OPI) No. 33826/73, developing agents which react with amidorazone compounds as described in Japanese Patent Publication No. 39165/73, etc., reducing agents which per se are oxidized to form dyes or lakes (e.g., tetrazonium salts, 2,4-diaminophenol, α-nitroso-β-naphthol, leuco dyes, reducing agents which can form colored images after oxidation, as described in Japanese Patent Application (OPI) No. 6338/72, pages 9 to 13, etc. There are many useful types of reducing agents; one type is a reducing agent per se (being a developing agent), so that in order to form a dye it is necessary to oxidize the same and couple with a color former; another type forms a dye due to oxidation thereof; and a third type is previously colored, and is converted into a non-diffusible dye due to oxidation; etc.

The reducing agent which is used in the present invention may be incorporated in processing solutions, and/or in a light sensitive material. The term "processing solutions" refers to a developing solution and an intensifying solution. When the reducing agent is incorporated in a light sensitive material, it can be incorporated in a silver halide emulsion layer and/or a non-light sensitive photographic auxiliary layer adjacent thereto (e.g., a protective layer, a filter layer or an intermediate layer, etc.). When added to a processing solution, the reducing agent is usually added in an amount of not less than about 1 g/liter.

Preferred examples of p-phenylenediamine derivative color developing (reducing) agents include 2-amino-5-diethylaminotoluene hydrochloride, 2-amino-5-(N-ethyl-N-laurylamino)toluene, 4-[N-ethyl-N-(β-hydroxyethyl)amino]aniline sulfate, 2-methyl-4-[N-ethyl-N-(β-hydroxyethyl)amino]aniline sulfate, N-ethyl-N-(β-methanesulfoamidoethyl)-3-methyl-4-aminoaniline sesquisulfate monohydrate as described in U.S. Pat. No. 2,193,015, N-(12-amino-5-diethylaminophenylethyl)methanesulfonamido sulfate as described in U.S. Pat. No. 2,592,364, N,N-dimethyl-p-phenylenediamine hydrochloride, 4-amino-3-methyl-N-ethyl-N-methoxyethylaniline, 4-amino-3-methyl-N-ethyl-N-β-ethoxyethylaniline and 4-amino-3-methyl-N-ethyl-N-β-butoxyethylaniline, or salts thereof (for example, sulfates, hydrochlorides, sulfites, p-toluene sufonates, etc.) as described in U.S. Pat. Nos. 3,656,950 and 3,698,525, etc.

There are other types of reducing agents, one of which per se forms dye images when oxidized, and another type which forms a complex with a metal salt; examples of which are developing agents as described in British Pat. No. 1,210,417, tetrazonium salts as described in U.S. Pat. No. 3,655,382, 2,4-diaminophenol, α-nitroso-β-naphthol, etc. These reducing agents are oxidized with halogenous acid compounds and/or peroxide compounds in the presence of a catalyst, but undergo oxidation at an extremely slow oxidation rate at areas where no catalyst is present; the reducing agents funtion either per se as an image-forming element or form images by reaction of the oxidation product thereof with a color former.

Conventional photographic materials contain 3 to 10 g/ $m^2$ of silver salt calculated as silver. Even printing materials contain about 1 to about 4 g/$m^2$ of silver salt as silver. In the photographic materials of the present invention, the coated amount of silver is below about 5 g/$m^2$, and may further be reduced to below 3 g/$m^2$. Usually, the amount of silver is 1 m/$m^2$ to 3 g/$m^2$. In a multi-color photographic light sensitive material, the coated amount of silver is less than about 2 g/m² per one light sensitive layer, most especially 1 g/m² to 1 mg/m².

The color former which is used in the present invention is a compound which reacts with oxidized developing agent to form a dye. Examples of the color formers include compounds conventionally used in ordinary color light sensitive materials such as open-chain ketomethylene type couplers, 5-pyrazolone type couplers, indazolone type couplers, phenol or naphthol type couplers; diffusible dye releasing (DDR) type couplers which react with color developing agents as are described in British Pat. No. 840,731, U.S. Pat. No. 3,227,550, Japanese patent application (OPI) No. 123,022/74, and Japanese patent application No. 57040/75, etc., to release a diffusible dye; amidrazones which react with the oxidation product of a developing agent as are described in Japanese Patent Publication No. 39165/73, etc., to release a diffusible dye, etc.

A representative example of a photographic element in the present invention can include the incorporation of a coupler into a light sensitive material, whereby the coupler should be used in an amount sufficient to give the color density required. Accordingly, the coupler is used in an amount equimolar to or more of the amount of silver ordinarily present. Couplers employed can be those which are known and such can be optionally chosen.

Specific examples of couplers which are employed in the present invention are as follows: yellow couplers are generally exemplified by open-chain ketomethylene type compounds, which are described in, for example, U.S. Pat. Nos. 3,341,331, 2,875,057 and 3,551,155, German Patent Application (OLS) No. 1,547,868, U.S. Pat. Nos. 3,265,506, 3,582,322 and 3,725,072, German Patent Application (OLS) No. 2,162,899, U.S. Pat. Nos. 3,369,895 and 3,408,194, German Patent Applications (OLS) Nos. 2,057,941, 2,213,461, 2,219,917, 2,261,361 and 2,263,875, etc.

As magenta couplers, there ar mainly used 5-pyrazolone type compounds, but indazolone type compounds and cyanoacetyl compounds are also used. Examples of these magenta couplers are described in, for example, U.S. Pat. Nos. 2,439,098, 2,600,788, 3,062,653 and 3,558,319, British Pat. No. 956,261, U.S. Pat. Nos. 3,582,322, 3,615,506, 3,519,429, 3,311,476 and 3,419,391, Japanese Patent Applications Nos. 21454/73 and 56050/73, German Pat. No. 1,810,464, Japanese Patent Publication No. 2016/69, Japanese Patent Application No. 45971/73, U.S. Pat. No. 2,983,608, etc.

Cyan couplers are mainly exemplified by phenol derivatives or naphthol derivates. Examples of these cyan couplers are shown in, for example, U.S. Pat. Nos. 2,369,929, 2,474,293, 2,698,794, 2,895,826, 3,311,476, 3,458,315, 3,560,212,3,582,322, 3,591,383, 3,386,301, 2,434,272, 2,706,684, 3,034,892, and 3,583,971, German Patent Application (OLS) No. 2,163,811, Japanese Patent Publication 28836/70, Japanese Patent Application No. 33238/73, etc.

In the color reactions described above, development inhibitor releasing type couplers (so-called DIR couplers) or compounds which release compounds having a development inhibiting effect can also be added. Examples of these compounds are shown in U.S. Pat. Nos. 3,148,062, 3,277,554, 3,253,924, 3,617,291, 3,622,328, and 3,705,201, British Pat. No. 1,201,110, in U.S. Pat. Nos. 3,297,445, 3,379,529 and 3,639,417, etc.

In order to satisfy the characteristics sought in a light sensitive material, two or more kinds of the aforementioned couplers may be incorporated into a single layer in combination. Needless to say, one coupler may also be incorporated into two or more different layers.

The color former which is incorporated in a unit layer of the present invention is a water-insoluble color former which is mixed in a color former solvent (preferably, a color former sovlent having an appropriate polarity). Typical examples of useful solvents are tri-o-cresyl phosphate, trihexyl phosphate, di-butyl phthalate, diethyl laurylamide, 2,4-diallylphenol, liquid dye stabilizers as described in *Product Licensing Index*, volume 83, pages 26–29, published March, 1971, entitled "Solvents for Stabilizing Dye Images for Improved Photography", etc. It appears that an element containing a color former solvent still accelerates absorption of a color developing solution during processing transfer from a developing bath to a intensifying bath.

It is convenient that the color former for photography used be chosen so as to give an intermediate scale image. It is preferred that the maximum absorption area of a cyan dye formed by a cyan color former be between about 600 to about 720 nm; the maximum absorption area of a magenta dye formed by a magenta color former be between about 500 and about 580 nm; and, the maximum absorption area of a yellow dye formed by a yellow color former be between about 400 and about 480 nm.

A silver halide emulsion as is used in the present invention is generally prepared by mixing a water-soluble silver salt (e.g., silver nitrate) solution with a water-soluble halide (e.g., potassium bromide) solution in the presence of a solution of a water soluble high molecular weight substance such as gelatin. In addition to silver chloride and siler bromide, mixed silver halides, for example, silver chlorobromide, silver iodobromide, silver chloroiodobromide, etc., can also be employed as a silver halode.

The shape of the silver particles thereof may by any one of cubic, hexagonal, mixed crystals thereof, etc.

In addition, two or more silver halide photographic emulsions which are separately prepared may be mixed. Further, the crystal structure of silver halide particles may be the same as a whole, or have a layer structure which is different between the shell and the core thereof, or be of the conversion type as is described in British Pat. No. 635,841 and U.S. Pat. No. 3,622,318. Furthermore, the silver halide may also be of the type which forms a latent image mainly on the surface thereof or an inner latent image type which forms an image inside the particles thereof. These photographic emulsions are described in Mees, *The Theory of the Photographic Process*, published by MacMillan Co., P. Glafkides, *Chimie Photographique*, published by Paul Montel Co., (1957), and can be prepared by an ammonia method, a neutral method, an acidic method, etc., which are art recognized.

The aforesaid silver halide emulsions can be subjected to chemical sensitization in a conventional manner. Examples of chemical sensitizers are gold compounds such as chloroaurate, gold trichloride, as described in U.S. Pat. Nos. 2,399,083, 2,540,085, 2,597,856 and 2,597,915; salts of noble metals such as platinum, palladium, iridium, rhodium, ruthenium, as described in U.S. Pat. Nos. 2,448,060, 2,540,086, 2,566,245, 2,566,263 and 2,598,079; sulfur compounds which form silver sulfide by reacting with silver salts as are described in U.S. Pat. Nos. 1,574,944, 2,410,689, 3,189,458, and 3,501,313; stannous acid salts, amines, other reducing materials or the like as are described in U.S. Pat. Nos. 2,487,850, 2,518,698, 2,521,925, 2,521,926, 2,694,637, 2,983,610 and 3,201,254, etc.

In some cases, it is preferred that the photographic element further contain various additives in order to obtain the desired development characteristics, image characteristics, film-forming phsical properties, etc. Preferred examples of such additives are iodine compounds in the salt form thereof, organic compounds having a free mercapto group, e.g.,phenylmercaptotetrazole, alakli metal iodides, etc. However, it is desired to avoid the use of the same in a large amount.

Preferred examples of anti-fogging agent optionally incorporated in light sensitive silver halide emulsion layers and non-light sensitive auxiliary layers of a photographic element are, in general, a heterocyclic organic compound such as a tetrazole, azaindene, trazoles (for example, methylbenzotraizole, nitrobenzotriazole, etc.), benzimidazoles (for example, benzimidazole, etc.), etc.

A hardening agent, a plasticizer, a smoothening agent, a surface active agent, a luster improving agent, and other conventional additives in the photographic art may further be incorporated in the photographic element, if desired.

Examples of hydrophilic colloids used include conventional materials such as cellulose derivatives such as gelatin, colloidal albumin, casein, caboxymethyl cellulose, hydroxyethyl cellulose, etc., sucruse derivatives such as agar, sodium alginate, starch derivatives, etc., synthetic hydrophilic colloids, for example, polyvinylalcohol, poly-N-pyrrolidone, polyacrylic acid copolymers, polyacrylamides or derivatives thereof, partial hydrolysates thereof, etc. If desired or necessary, a compatible mixture of two or more of these colloids can be employed. Of these colloids, gelatin is most generally used, but it can be partly or wholly replaced with other high molecular weight substances as exemplified; alternatively, gelatin derivatives may also be employed, e.g., gelatin reacted with phthalic anyhydride, etc.

The photographic emulsion can be subjected to spectral sensitization if desired or necessary, using a cyanine dye alone, such as a cyanine, merocyanine, carbocyanine, etc., dye, or a combination thereof, or in combination with a styryl dye, etc. Such spectral sensitizing techniques are well known and are described in, for example, U.S. Pat. Nos. 2,493,748, 2,519,001, 2,977,229, 3,480,434, 3,672,897, 3,703,377, 2,688,545, 2,912,329, 3,397,060, 3,615,635, and 3,628,964, British Pat. Nos. 1,195,302, 1,242,588 and 1,293,862, German Patent Applications (OLS) Nos. 2,030,326 and 2,121,780, Japanese Patent Publications Nos. 4936/68, 14030/69 and 10773/68, U.S. Pat. Nos. 3,511,664, 3,522,052, 3,527,641, 3,615,613, 3,615,632, 3,617,295, 3,635,721, and 3,694,217, British Pat. Nos. 1,137,580 and 1,216,203, etc. The technique can be optionally used chosen depending upon the purpose and utility of the light sensitive material such as the wavelength area to be sensitized, the sensitivity, etc.

The photographic element of the present invention comprises a support having thereon at least one silver halide emultion layer; usually, on a support, there are provided, a red-sensitive silver halide emulsion layer, a green-sensitive silver halide emulsion layer and a blue-sensitive silver halide emulsion layer. Alternatively, on a support, there are provided a red-sensitive silver halide emulsion layer containing a cyan image-forming coupler, a green-sensitive silver halide emulsion layer containing a magenta image-forming coupler, and a blue-sensitive silver halide emulsion layer containing a yellow image-forming coupler. Such a photographic element may further contain various non-light sensitive photographic layers (for example, an anti-halation layer, an intermediate layer preventing color mixing, a yellow filter layer, a protective layer, etc.). In addition, the order of the red-sensitive layer, green-sensitive layer and blue-sensitive layer may be from the support, a red-sensitive layer, a green-sensitive layer and a blue-sensitive layer, or the like, and such is not specifically limitative. Further, the photographic element of the present invention includes the case where a single emulsion layer as described in U.S. Pat. No. 3,726,681, British Pat. Nos. 818,687, and 923,045, U.S. Pat. No. 3,516,831, Japanese Patent Applications Nos. 5179/75 and 42541/75, etc., is composed of plural unit emulsions, or other various layer structures.

Examples of photographic supports are a cellulose nitrate film, a cellulose acetate film, a cellulose acetate butyrate film, a cellulose acetate propionate film, a polystyrene film, a polyethylene terephthalate film, a polycarbonate film, laminates thereof, thin glass, paper, etc., which are generally used in photographic light sensitive materials. In particular, baryta paper or a paper sheet having coated or laminated thereon an $\alpha$-olefin polylmer, especially a polymer of an $\alpha$-olefin having 2 to 10 carbon atoms such as polyethylene, polypropylene, an ethylenebutene copolymer, etc., a plastic film as described in Japanese Patent Publication No. 19068/72 in which the surface is roughened and thereby adhesion to other high molecular weight substances is improved, etc., give good results.

These suppports are chosen depending upon the purpose or end use of the light sensitive materials whether they be transparent or opaque. In the case of a transparent material, not only can a colorless transparent material be used but also a colored transparent material which has a dye or pigment added thereto can be used. Such a technique is conventionally used in the X-ray film art and is described in *J. SMPTE,* 67,296 (1958).

Opaque supports include, in addition to inherently non-transparent materials such as paper, materials obtained by adding dyes or pigments such as titanium dioxide to a transparent film, a plastic obtained by a surface treatment as is shown in Japanese Patent Publication No. 19068/72, paper or a plastic film which is rendered completely light-shielding by adding carbon black, dyes, etc., thereto. There can be provided as a subbing layer a layer which possesses good adhesion to the support and a photographic emulsion layer. In addition, in order to further improve adhesion, the surface of the support may be subjected to a preliminary treatment such as a corona discharge treatment, an ultraviolet treatment, a flame treatment, etc.

The photographic element of the present invention comprises a support having thereon a dye image-providing unit layer. A multicolor photographic element comprises at least two dye image-providing unit layers as aforementioned, each of which records light in a different spectral region. A unit layer contains a light sensitive silver salt, which is spectrally light sensitive to light at a specific wavelength region in general, and is used in combination with a photographic color former. The color-providing layers are effectively separated from each other by a barrier layer, a spacing layer, a layer containing an agent to remove oxidation product upon development, or other layers in order to avoid color contamination between dye image-providing unit layers. Effective separation of unit layers is known in this art and is utilized in many commercial color products to prevent such contamination. A light sensitive material having a layer preventing development contamination as is described in U.S. Pat. No. 3,737,317 and Japanese Patent Applications Nos. 73455/73 and 113633/73 can be used in the present invention, if desired.

The photograhic element layers which are actually used in the present invention may be coated by various coating methods such an immersion method, an air knife coating method, a curtain coating method, or an extrusion coating method using a hopper as is described in U.S. Pat. No. 2,681,294, etc.

If desired, two or more layers may be coated at the same time by methods as described in U.S. Pats. Nos. 2,761,791, 3,508,947 and British Pat. No. 837,095. The photographic element may be designed for a color image transfer method as described in U.S. Pats. Nos. 3,087,817, 3,185,567, 2,983,606, 3,253,915, 3,227,550, 3,227,551, 3,227,552, 2,145,633, 3,415,645, and 3,415,646, or an absorption transfer method as is described in U.S. Pat. No. 2,882,156, etc. When a preformed dye type color former or a DRR type (dye releasing redox compound type) color former is used in the photographic element, at least two color-providing unit layers which contain at least a 40% excess of each of the color formers therein based on the stoichiometric amount with respect silver in the layers are used.

The developer which is used in the present invention contains one or more developing agents (reducing agents) as aforementioned, and, in addition, may contain other components conventionally contained in known developers. As the components of such developers, all components which can be incorporated in an intensifying solution as described hereinbefore can be used.

In addition, the following additives can be incorporated in the color developer, if desired or necessary.

For example, examples of competitive couplers such as citrazinic acid, J-acid (2-amino-5-naphthol-7-sulfonic acid) or H-acid (8-amino-1-naphthol-3,6-disulfonic acid) as are described in Japanese Patent Publications Nos. 9505/69, 9506/69, 9507/69, 14036/70 and 508/69, U.S. Pats. Nos. 2,742,832, 3,520,690, 3,560,212 and 3,645,737, etc., can be used.

Fogging agents such as alkali metal borohydrides, amine boranes, or ethylene diamine as exemplified by those as described in Japanese Patent Publication No. 38816/72, etc., can also be used.

Complementary developers such as p-aminophenol, benzyl-p-aminophenol or 1-phenyl-3-pyrazolidone as exemplified by those described in Japanese Patent Publications Nos. 41475/70, 19037/71, 19438/71, etc., can also be used, if desired.

It is preferred that the addition amount of such complementary developers be 0.01 to 1.0 g/liter, in general.

Typical examples of color developers comprising various components as aforementioned are shown in *Kagaku Shashin Binran* (*Handbook of Photographic Technology*), page 72 (1959), published by Maruzen Co., Tokyo.

One representative process which falls within the present invention comprises developing a silver halide color light sensitive material, intensifying, bleaching, fixing (or bleach-fixing), washing with water and drying to provide dye images. After intensifying, water-washing may be carried out and bleaching may further be carried out.

Further, another process comprises conducting both development and intensification, whereby a developing agent is incorporated in an emulsion layer or a layer adjacent thereto and is treated with an intensifying liquid containing a peroxide compound, a chlorite, chlorous acid and/or chlorine dioxide aqueous solution, but without treating with a developer, bleaching, and subsequently fixing, or bleach-fixing, washing with water and drying to provide dye images.

Still another process comprises conducting a monobath development, intensification-fixing (whereby a light sensitive material containing a developing agent in an emulsion layer or a layer adjacent thereto is treated with an intensifying liquid containing a fixing agent) rinsing and drying. As a modification thereof, a monobath development intensification and stabilization which does not require water washing or rinsing can also be carried out.

In another process, couplers may be incorporated in a developer. As such diffusible couplers used in the color developing solution which are used by adding them to a developer, there are cyan couplers as are described in, for example, U.S. Pat. Nos. 3,002,836 and 3,542,552, etc., magenta couplers as are described in, for example Japanese Patent Publication No. 13111/69, etc., yellow couplers as are described in U.S. Pat. No. 3,510,306, etc. In this case, the coupler is used in a concentration of about 0.5 to about 5 g/liter, preferably 1 to 2.5 g/liter.

In another process, development is performed by a developer being permeated between a light sensitive layer and an image-receiving layer laminated to each other, whereby a dye which is rendered diffusible by oxidation by a chlorite, chlorous acid and/or chlorine dioxide aqueous solution is diffused into the image-receiving layer. Conversely, a diffusible dye can also be transferred as an image from areas where no oxidation occurs.

In color photography, subtractive type dye images can be formed by a color negative method as is described in W. T. Hanson and W. I. Kesner, *Journal of the Society of Motion Picture and Television Engineers*, volume 61, pages 667–701 (1953); or images can be formed by a color reversal method (forming a reversal silver image in a conventional manner) which comprises imagewise exposing the element to light using either a direct positive emulsion or a negative emulsion, developing the same in a black-and-white developer to form a negative silver image, further exposing the same to light at least once (or conducting another type of fogging), and subsequently developing to form a subtractive type colored dye image. In this case, bleaching is usually carried out after black-and-white development in order to prevent primary developed silver from acting as a catalyst, and an intensifying step is provided after color development.

Processing temperatures used in the present invention may be at any temperature, but generally, processing is performed at temperatures of from 10° C to 70° C, preferably 20° C to 60° C.

While not to be construed as overly limitative, on commercial scale operation it is most preferred that the reducing agent be present in an amount of from about 1 g/liter to about 20 g/liter, the bromide be present in an amount of from about $1 \times 10^{-4}$ g ion/liter to about $1 \times 10^{-1}$ g ion/liter and the highly active intensifying agent be present in an amount of from about 0.25 mol/liter to about 3 mol/liter.

The present invention is illustrated in detail by examples below, but the embodiments of the present invention are not limited thereto.

EXAMPLE 1

A color light-sensitive material as described below was applied onto a conventional polyethylene coated paper support.

| Multi-Layer Light-Sensitive Material (Figures in parenthesis appearing below show the amount as coated ($mg/m^2$) ) | |
|---|---|
| Sixth Layer: | Gelatin (1,000) |
| Fifth Layer: | Red-sensitive layer |
| | Silver halide emulsion AgBrCl (Br 50 mol%) Silver (100) |
| | Cyan coupler*1 (400) |
| | Gelatin (1,000) |
| | Solvent for coupler*2 (200) |
| Fourth Layer: | Gelatin (1,200) |
| | UV absorbant* (1,000) |
| | Dioctylhydroquinone (50) |
| | * 2-(2-benzotriazolyl)-2-sec-butyl-4-t-butylphenol |
| Third Layer: | Green-sensitive layer |
| | Silver halide emulsion AgBrCl (Br 50 mol%) Silver (100) |
| | Magenta coupler*3 (300) |
| | Solvent for coupler*4 (300) |
| Second Layer: | Gelatin (1,000) |
| | Dioctylhydroquinone (50) |
| First Layer: | Blue-sensitive layer |
| | Silver halide emulsion AgBrCl (Br 80 mol%) Silver (150) |
| | Gelatin (1,200) |
| | Yellow coupler*5 (300) |
| | Solvent for coupler (150) |
| Support | |
| *1 Coupler: | 2-[α-(2,4-di-t-amylphenoxy)butanamido]-4,6-dichloro-5-methylphenol |
| *2 Solvent: | Dibutyl phthalate (DBP) |
| *3 Coupler: | 1-(2,4,6-trichlorophenyl)-3-[2-chloro-5-tetradecaneamido]anilino-2-pyrazolon-5-one |
| *4 Solvent: | Tricresyl Phosphate |
| *5 Coupler: | α-Pivaloyl-α-[2,4-dioxo-5,5-dimethyloxazolidine-3-yl]-2-chloro-5-[γ-(2,4-di-t-amylphenoxy)butanamido]acetanilide |

The light sensitive material was exposed to light using a sensitometer (1,000 lux, for 1 second) and then subjected to the following processing.

| Composition of Developer | | |
|---|---|---|
| Benzyl Alcohol | | 15 ml |
| $Na_2SO_3$ | | 5 g |
| KBr | | 0.4 g |
| Hydroxylamine Sulfate | | 2 g |
| 4-Amino-3-methyl-N-ethyl-N-β-(methanesulfonamido)ethylaniline | | 10 g |
| $Na_2CO_3 . H_2O$ | | 30 g |
| Diaminopropanol Tetraacetic Acid | | 5 g |
| Water to make | | 1,000 ml |
| | | pH 10.1 |
| Bleach-Fixing Solution | | |
| Ammonium Thiosulfate (70%) | | 50 ml |
| $Na_2SO_3$ | | 5 g |
| NaFe [EDTA]* | | 10 g |
| EDTA | | 1 g |
| Water to make | | 1,000 ml |
| | | pH 6.8 |
| *(Ethylene diaminetetraaceto)ferro (III) complex monosodium salt | | |
| Processing Steps | | |
| Color Development | 40° C | 1 min |
| Intensification | 40° C | 1 min |
| Water Washing | 25–40° C | 1 min |
| Bleach-Fixing | 40° C | 1 min |
| Water Washing | 40° C | 1 min & 30 secs. |
| Drying | | |

Various intensifying baths (pH 10.1) were prepared by adding the following compounds and water to make 1,000 ml. The earlier described Light Sensitive Material was processed with the intensifying baths, the results of which are shown in Table 1 and 2.

| Component | Intensifying Baths | | | | | | | | | |
|---|---|---|---|---|---|---|---|---|---|---|
| Bath No. | A | B | C | D | E | F | G | H | I | J |
| Sodium Chlorite | — | 20 g | 20 g | 20 g | 20 g | 60 g | " | " | " | " |
| Compound 1 | — | — | 100mg | 100mg | 100mg | — | 100mg | " | " | " |
| Sodium Carbonate | 10 g | " | " | " | " | " | " | " | " | " |
| Diethylenetriamine-pentaacetic Acid | 2g | " | " | " | " | " | " | " | " | " |
| KBr | — | — | — | 100mg | 200mg | — | — | 100mg | 200mg | 400mg |

All component are per liter of intensifying bath.

Table 1.
Fog Density

| | A | B | C | D | E | F | G | H | I | J |
|---|---|---|---|---|---|---|---|---|---|---|
| Cyan Density | 0.12 | 0.30 | 0.12 | 0.10 | 0.09 | 0.35 | 0.13 | 0.10 | 0.09 | 0.09 |
| Magenta Density | 0.09 | 0.25 | 0.09 | 0.08 | 0.08 | 0.32 | 0.10 | 0.08 | 0.08 | 0.08 |
| Yellow Density | 0.08 | 0.45 | 0.09 | 0.08 | 0.08 | 0.50 | 0.10 | 0.08 | 0.08 | 0.08 |

Table 2.
Density at a Point Shifted by 0.3 log E from Density 1.0 to a Higher Exposure

| | A | B | C | D | E | F | G | H | I | J |
|---|---|---|---|---|---|---|---|---|---|---|
| Cyan Density | 1.55 | 1.90 | 2.10 | 1.50 | 1.40 | 2.10 | 2.20 | 1.80 | 1.78 | 1.75 |
| Magent Density | 1.15 | 2.00 | 2.10 | 1.30 | 1.20 | 2.20 | 2.30 | 1.75 | 1.73 | 1.70 |
| Yellow Density | 1.20 | 1.70 | 1.80 | 1.30 | 1.20 | 1.80 | 1.90 | 1.70 | 1.70 | 1.65 |

When 20 g (0.2 mol/liter) of sodium chlorite was employed as the intensifying agent, fog was greatly reduced by the addition of an anti-fogging agent; however, the intensifying effect was reduced when using 100 mg/liter of KBr, and, when using 200 mg/liter of KBr the intensifying effect became substantially the same as in the case when no intensifying agent was used. However, when 60 g (0.67 mol/liter) of an intensifying agent was employed, while the intensifying effect was decreased due to the addition of 100 mg/liter of KBr, the intensifying effect was almost not decreased to any greater extent even if KBr was added in an amount from 100 mg/liter to up to 400 mg/liter.

In addition, there was a sufficient intensifying effect of each of Samples D, E, H, I and J as compared to Sample A.

By the addition of KBr in an amount of $1 \times 10^{-4}$ mol/ liter or more, photographic properties are not affected by KBr coming from a developer, and a stable intensifying bath can be provided.

EXAMPLE 2

The following composition was coated onto a conventional polyethylene coated paper support.

| Multi-Layer Coating Sample. (Numerals in Parenthesis appearing below show the amount as coated (mg/m²)) | |
|---|---|
| Sixth Layer: | Gelatin (1,000) |
| Fifth Layer: | Red-sensitive layer |
| | AgBrCl Emulsion (Br 70 mol%) |
| | Ag (60) |
| | Gelatin (600) |
| | Cyan coupler*6 (400) |
| | Solvent for coupler*2 (200) |
| Fourth Layer: | Gelatin (1,800) |
| | UV Absorbant* (700) |
| | Dioctylhydroquinone (50) |
| | * 2-(2-benzotriazolyl)-2-sec-butyl-4-t-butylphenol |
| Third Layer: | Green-sensitive layer |
| | AgBrCl Emulsin (Br 30 mol%) |
| | Ag (90) |
| | Gelatin (600) |
| | Magenta coupler*3 (350) |
| | Solvent for coupler *4 (175) |
| Second Layer: | Gelatin (800) |
| | Dioctylhydroquinone (50) |
| First Layer: | Blue-sensitive layer |
| | AgClBr Emulsion (Br 70 mol%) |
| | Ag (120) |
| | Gelatin Emulsion |
| | Yellow Coupler *7 (750) |
| | Solvent for coupler *8 (250) |
| Support | |

*6 Coupler: 2-(Hexafluorobutaneamido)-5-[α-(2,4-di-t-amylphenoxy)butaneamido]-4-chlorophenol

*7 Coupler: α-Pivaloyl-α-(2,4-dioxo-5,5-dimethylhydantoin-3-yl)-2-chloro-5-[α-2,4-di-t-amylphenoxy)butanamido]acetanilide

*8 Solvent: Dioctylbutyl phosphate

*2 and *4 are the same as in Example 1.

The sample was exposed to light using a sensitometer and then subjected to the following processings.

| Color Developer | |
|---|---|
| $K_2SO_3$ | 4 g |
| KBr | 0.5 g |
| Hydroxlamine Sulfate | 2.0 g |
| $K_2CO_3$ | 30 g |
| Sodium Nitrilotriacetic Acid | 2.0 g |
| 4-Amino-N-ethyl-N-(2-methoxyethyl)-m-toluidine-di-p-toluene Sulfonic Acid | 8.0 g |
| KOH | 1.2 g |
| Water to make | 1,000 ml |
| | pH 10.1 |
| **Bleach-Fixing Solution** | |
| EDTA-4 Na* | 3 g |
| Glacial Acetic Acid | 20 cc |
| Ammonium Thiosulfate (70%) | 130 cc |
| $Na_2SO_3$ | 15 g |
| $CO(NH_3)_6Cl_3$ | 3 g |
| Water to make | 1,000 ml |
| | pH 4.3 |

* Ethylenediaminetetraacetic acid tetra-sodium salt

| Processing Steps | Temp. | Time |
|---|---|---|
| Color Development | 40° C | 1 min. |
| Intensification | 40° C | 1 min |
| Water Washing | 25–40° C | 1 min |
| Bleach-Fixing | 40° C | 1 min |
| Water Washing | 25–40° C | 1 min & 30 secs. |

The intensifying baths used had has the following compositions:

| Component | Intensifying Baths | | | | | | | |
|---|---|---|---|---|---|---|---|---|
| Bath No. | K | L | M | N | O | P | Q | R |
| $H_2O_2$(30% | — | 25 ml | 25 ml | 25 ml | 100 ml | " | " | " |
| $Na_2HPO_4 \cdot 12H_2O$ | 20 g | " | " | " | " | " | " | " |
| $Na_4P_2O_7 \cdot 10H_2O$ | 1 g | " | " | " | " | " | " | " |
| $Na_2SnO_3$ | 200 mg | " | " | " | " | " | " | " |
| EDTA-4Na | 100 mg | " | " | " | " | " | " | " |
| Compound 5 | — | 100 mg | " | " | " | " | " | " |
| KBr | — | — | 20 mg | 200 mg | — | 20 mg | 200 mg | 400 mg |

All components are per liter of intensifying bath.

Each of the intensifying baths was made 1,000 ml by adding water. pH 9.0

Density was measured using a densitometer, and the results thereof are shown in Tables 3 and 4.

Table 3

| Intensifying Bath | Fog Density | | | | | | | |
|---|---|---|---|---|---|---|---|---|
| | K | L | M | N | O | P | Q | R |
| Cyan Density | 0.12 | 0.10 | 0.08 | 0.08 | 0.10 | 0.08 | 0.08 | 0.08 |
| Magenta Density | 0.12 | 0.11 | 0.08 | 0.08 | 0.10 | 0.08 | 0.08 | 0.08 |
| Yellow Density | 0.11 | 0.10 | 0.09 | 0.09 | 0.10 | 0.09 | 0.09 | 0.09 |

Table 4

| Intensifying Bath Used | Density at the Point Shifted by 0.3 logE from Density 1.0 to Higher Exposure | | | | | | | |
|---|---|---|---|---|---|---|---|---|
| | K | L | M | N | O | P | Q | R |
| Cyan Density | 1.55 | 2.00 | 1.70 | 1.50 | 2.20 | 2.00 | 1.95 | 1.90 |
| Magenta Density | 1.20 | 2.00 | 1.50 | 1.40 | 2.10 | 1.95 | 1.90 | 1.90 |
| Yellow Density | 1.20 | 1.80 | 1.40 | 1.30 | 1.90 | 1.80 | 1.80 | 1.75 |

When using 25 ml. of hydrogen peroxide (30%), the intensifying effect was greatly reduced due to the addition of 20 mg of KBr, and, due to the addition of 200 mg/liter of KBr, became substantially the same as in the case of using no intensifying agent.

However, in the present invention (Runs P, A and R), while the intensifying effect was indeed reduced by KBr, there was retained a sufficient effect even when using 400 mg/liter of KBr and there was very little formation of fog.

From the results above, the superiority of the present invention is well established.

While the invention has been described in detail and with reference to specific embodiments thereof, it will be apparent to one skilled in the art that various changes and modifications can be made therein without departing from the spirit and scope thereof.

What is claimed is:

1. In a process involving color image-formation followed by photographic processing including color developing which comprises contacting an image-wise exposed color photographic element comprising a support having provided thereon at least one silver halide emulsion layer with an intensifying bath containing at least one highly active intensifying agent comprising halogenous acid(s) or peroxide(s) in the presence of a reducing agent, which is in a processing bath or the element, and in the presence of a color former, the improvement wherein said intensifying bath comprises at least one nitrogen-containing heterocyclic compound having no mercapto group and which possesses an anti-fogging effect, of the formula:

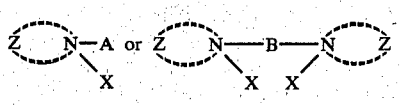

wherein Z is a non-metallic group comprising carbon, nitrogen, oxygen, sulfur or selenium, which forms a 5- or 6-membered heterocyclic ring or a heterocyclic ring condensed with a 5- or 6-membered ring, X is an anion other than I, A is a substituted or unsubstituted alkyl group, an alkenyl group, an alkynyl group, a cycloalkyl group having 5 to 10 carbon atoms, or a substituted or unsubstituted aryl group, and B is $-(CH_2)_n-$, $-CH_2O-(CH_2)_n-OCH_2-$,

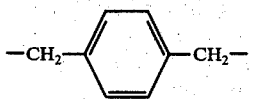

or $-CH_2OCH_2-$, wherein $n$ is an integer of 1 to 12, bromide ions in an amount of $1 \times 10^{-4}$ gram ion/liter or more, and said highly active intensifying agent in an amount of 0.25 mol/liter or more.

2. The process involving color image-formation followed by photographic processing including color developing which comprises contacting an image-wise exposed color photographic element comprising a support having thereon at least one silver halide emulsion layer containing im age-wise distributed silver catalyst nuclei with an intensifying bath containing at least one highly active intensifying agent comprising a halogenous acid or a peroxide in the presence of a reducing agent, which is in a processing bath or the element and in the presence of a color former, and thereby image-wise oxidizing the reducing agent to thereby conduct image intensification through said oxidized reducing agent, the improvement wherein said intensifying bath comprises at least one nitrogen-containing heterocyclic compound having no mercapto group and which possesses an anti-fogging effect, bromide ions in an amount of $1 \times 10^{-4}$ gram ion/liter or more, and said highly active intensifying agent in an amount of 0.25 mol/liter or more, wherein said nitrogen-containing heterocyclic compound is of the formula:

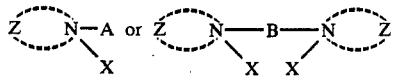

wherein Z is a non-metallic group comprising carbon, nitrogen, oxygen, sulfur or selenium, which forms a 5- or 6-membered heterocyclic ring or a heterocyclic ring condensed with a 5- or 6-membered ring, X is an anion other than iodide, A is a substituted or unsubstituted alkyl group having 1 to 4 carbon atoms wherein said substituent is a hydroxyl group, an alkoxy group having 1 to 4 carbon atoms, a carboxy group, or a sulfo group; or A is an alkenyl group having 2 to 10 carbon atoms, an alkynyl group having 2 to 10 carbon atoms, a cycloalkyl group having 5 to 10 carbon atoms, or a substituted or unsubstituted aryl group wherein said substituent is a hydroxy group, an alkoxy group having 1 to 4 carbon atoms or alkyl group having 1 to 4 carbon atoms, and B is $-(CH_2)_n-$, $-CH_2O-(CH_2)_n-OCH_2-$,

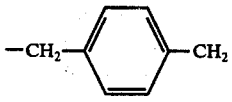

or $-CH_2OCH_2-$, wherein $n$ is an integer of 1 to 12.

3. The method for forming images as claimed in claim 2 wherein said nitrogen-containing heterocyclic compound is:

(III)

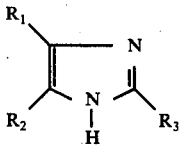

(IV)

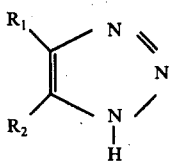

(V)

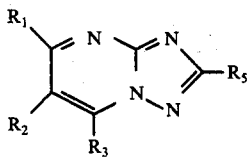

(VI)

-continued

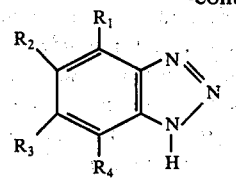

(VII)

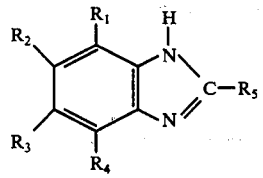

or (VIII)

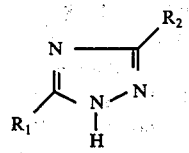

wherein $R_1$, $R_2$, $R_3$ and $R_4$ each represents a hydrogen atom, an alkyl group, an aralkyl group, an alkenyl group, an aryl group, $—NH_2$, $—NO_2$, a halogen atom or OH, and when $R_1$ and $R_2$ are alkyl groups they may combine together to form a cycloalkyl group, and $R_5$ represents a hydrogen atom or an alkyl group having 1 to 5 carbon atoms.

4. The method for forming images as claimed in claim 2 wherein said halogenous acid is chlorous acid, bromous acid, or a water soluble salt thereof.

5. The method for forming images as claimed in claim 4 wherein said water soluble salt is a salt of an alkali metal, an alkaline earth metal or ammonium.

6. The method for forming images as claimed in claim 2 wherein said peroxide is hydrogen peroxide, chlorine dioxide, a peroxoborate, a peroxocarbonate, a peroxosilicate, a peroxophosphate or a perbenzoic acid salt.

7. The method for forming images as claimed in claim 6 wherein said peroxide is hydrogen peroxide, a peroxoborate or a peroxocarbonate.

8. The method for forming images as claimed in claim 2, wherein said bromide ions are obtained by adding to an intensifying bath at least one water-soluble bromide represented by general formula (IX)

$$M(Br)_n \qquad \text{(IX)}$$

wherein, M represents an alkali metal, an alkaline earth metal and an ammonium group, and $n$ is 1 or 2.

9. The method of claim 2 wherein said highly active intensifying agent is present in an amount of about 0.25 to 17 mol/l, the intensifying bath having a pH of about 7 to 14.

10. The method of claim 2, wherein said reducing agent is a p-phenylenediamine color developing agent, an onium salt p-aminophenol color developing agent, a dye developer, a diffusible dye releasing redox compound, a developing agent capable of forming dyes by reaction with an amidorazone compound, a reducing agent capable of forming a dye or a lake by oxidation or a reducing agent capable of forming a color image after oxidation.

11. The method of claim 2, wherein said reducing agent is a p-phenylenediamine color developing agent of which the oxidation product couplers with a color former to form a dye, a reducing agent which is oxidized to form a dye by itself, or a color reducing agent which releases a non-diffusible dye by oxidation.

12. The image-forming method of claim 10, wherein said reducing agent is present in a silver halide emulsion layer of said photographic element or in a layer adjacent said silver halide emulsion layer.

13. The image-forming method of claim 10, wherein said reducing agent is a p-phenylenediamine derivative developing agent.

14. The image-forming method of claim 13, wherein said developing agent is N,N-diethyl-p-phenylenediamine, 2-amino-5-(N-ethyl-N-laurylamino)toluene, 4-[N-ethyl-N-(β-hydroxyethyl)amino]aniline, 2-methyl-4-[N-ethyl-N-(β-hydroxyethyl)amino]aniline, N-ethyl-N-(β-methanesulfoamidoethyl)-3-methyl-4-aminoaniline, N-(2-amino-5-diethylaminophenylethyl)methanesulfonamide, N,N-diethyl-p-phenylenediamine, 4-amino-3-methyl-N-ethyl-N-methoxyethylaniline, 4-amino-3-methyl-N-ethyl-N-β-ethoxyethylaniline or 4-amino-3-methoxy-N-ethyl-N-(β-butoxyethyl)aniline.

15. The image-forming method of claim 2, wherein the amount of silver coated on said photographic element is below about 5 g/m².

16. The image-forming method of claim 2, wherein the amount of silver coated on said photographic element is 1 mg/m² to 3 g/m².

17. The image-forming method of claim 2, wherein the photographic element includes at least two of silver halide emulsion layers and the silver is present in an amount of not more than 2 g/m² in each emulsion layer.

18. The image-forming method of claim 17, wherein the coated silver amount is 1 mg/m² to 1 g/m² in each layer.

19. The image-forming method of claim 2, wherein said photographic element contains a color coupler.

20. The image-forming method of claim 2, wherein the photographic element contains a color coupler and the weight ratio of said coupler to said silver halide is about 1 or more.

21. The image-forming method of claim 2, wherein said photographic element contains a color former solvent.

22. The image-forming method of claim 2, wherein the processing is carried out at about 10° to about 70° C.

23. The method of claim 2, wherein said nitrogen-containing heterocyclic compound having no mercapto group and which possesses an anti-fogging effect, is incorporated in an amount of about 1 mg to about 10 g, per 1 liter of an intensifying solution.

24. The image-forming method of claim 23, wherein said nitrogen-containing heterocyclic compound is incorporated in an amount of 10 mg to 5 g, per 1 liter of an intensifying solution.

25. The image-forming method of claim 2, wherein the intensifying step is either between color developing and the bleaching, is combined with color developing, or is combined with bleaching or fixing or blixing.

* * * * *